United States Patent [19]

Morris et al.

[11] 4,411,844

[45] Oct. 25, 1983

[54] PRIMING SYSTEM FOR A VENTED BOWL CARBURETOR

[75] Inventors: Richard L. Morris, Galesburg; Ronald B. Lloyd, Gilson, both of Ill.

[73] Assignee: Outboard Marine Corporation, Waukegan, Ill.

[21] Appl. No.: 347,909

[22] Filed: Feb. 11, 1982

[51] Int. Cl.[3] ..... F02M 1/16

[52] U.S. Cl. ..... 261/34 R; 261/DIG. 8; 92/92; 417/566

[58] Field of Search ..... 261/DIG. 8, 30, 72 R, 261/34 R; 92/92; 417/566, 479

[56] References Cited

U.S. PATENT DOCUMENTS

| | | | |
|---|---|---|---|
| 834,185 | 10/1906 | Campbell | 92/92 |
| 984,427 | 2/1911 | Hansen | 417/566 |
| 1,166,084 | 12/1915 | Ryder . | |
| 2,951,690 | 9/1960 | Eberline . | |
| 2,956,737 | 10/1960 | Hager . | |
| 3,118,596 | 1/1964 | Saile | 92/92 |
| 3,133,696 | 5/1964 | Mirando | 417/479 |
| 3,281,129 | 10/1966 | Payne . | |
| 3,307,836 | 3/1967 | Arndt et al. . | |
| 3,338,565 | 8/1967 | Heid . | |
| 3,345,045 | 10/1967 | Tuggle . | |
| 3,430,933 | 3/1969 | Taggart . | |
| 3,451,383 | 6/1969 | Nelson . | |
| 3,811,469 | 5/1974 | Fries | 417/566 |
| 3,822,720 | 7/1974 | Souza | 417/566 |
| 4,197,825 | 4/1980 | Altenbach . | |
| 4,203,405 | 5/1980 | Schultz et al. . | |
| 4,323,522 | 4/1982 | Rasmussen | 261/DIG. 8 |

FOREIGN PATENT DOCUMENTS

| | | |
|---|---|---|
| 598578 | 12/1925 | France . |

*Primary Examiner*—Tim R. Miles

*Attorney, Agent, or Firm*—Michael, Best & Friedrich

[57] ABSTRACT

A carburetor is provided with a primer for aiding in starting an engine, the primer including a priming bulb for forcing air into the air space in the float bowl to cause the air pressure in the air space to be greater than atmospheric pressure and to cause liquid fuel to be forced through the fuel nozzle and into said fuel-air mixture passage of the carburetor. The priming bulb includes a flexible wall having a groove and a vent opening is located in the base of the groove and is positioned so as to close as the priming bulb is compressed and as air is forced into the air space of the float bowl. The carburetor also includes a narrow passage permitting the venting of a portion of the air forced into the air space of the fuel bowl by the priming bulb to thereby control the amount of liquid fuel injected into the carburetor venturi.

5 Claims, 3 Drawing Figures

PRIMING SYSTEM FOR A VENTED BOWL CARBURETOR

FIELD OF THE INVENTION

The invention relates to a primer for assisting in the starting of an internal combustion engine and more particularly to a primer for use with a carburetor having a float bowl for containing fuel and to means for pressurizing the float bowl to facilitate flow of fuel from the float bowl into the fuel-air mixture passage of the carburetor.

BACKGROUND PRIOR ART

For reference to prior art apparatus providing means for priming an internal combustion engine, attention is directed to the Tuggle U.S. Pat. No. 3,345,045, issued Oct. 3, 1967; the Arndt et al. U.S. Pat. No. 3,307,836, issued Mar. 7, 1967; the Payne U.S. Pat. No. 3,281,129, issued Oct. 25, 1966; and the Taggart U.S. Pat. No. 3,430,933, issued Mar. 4, 1969.

Attention is further directed to the Heid U.S. Pat. No. 3,338,565, issued Aug. 29, 1967; the Altenbach U.S. Pat. No. 4,197,825, issued Apr. 15, 1980; the Schultz et al. U.S. Pat. No. 4,203,405, issued May 20, 1980; and the Nelson U.S. Pat. No. 3,451,383, issued June 24, 1969.

Attention is further directed to the Hager U.S. Pat. No. 2,956,737, issued Oct. 18, 1960; the Eberline U.S. Pat. No. 2,951,690, issued Sept. 6, 1960; the Ryder U.S. Pat. No. 1,166,084, issued Dec. 28, 1915; and French Pat. No. 598,578.

SUMMARY OF THE INVENTION

The invention includes an internal combustion engine having a carburetor for supplying the engine with a rich fuel-air mixture during priming and with a leaner mixture during normal operation. The carburetor includes a body with a fuel-air mixture passage, a float bowl adapted to contain a quantity of liquid fuel and having an air space above the liquid fuel, the float bowl also including an air inlet. The carburetor also includes a fuel nozzle for conducting fuel from the float bowl to the fuel-air mixture passage. A primer is provided for aiding in starting the engine, the primer including means for forcing air into the air space to cause the air pressure in the air space to be greater than atmospheric pressure and to cause liquid fuel to be forced through the nozzle and into the fuel-air mixture passage, the means for forcing including a manually operable flexible primer bulb adapted to be compressed to cause air to be forced into the air space and including a flexible wall adapted to partially collapse when pressure is applied to the bulb. The flexible wall includes a groove and a collapsible vent opening is provided in the groove, the vent opening being located so as to close as the priming bulb is compressed and as air is forced into the air space of the float bowl. A conduit extends between the priming bulb and the air inlet.

One of the principal features of the invention is a means for controlling the increase in air pressure in the air space as the priming bulb forces air into the air space. This means for controlling includes means for venting the air space to the atmosphere provided by a narrow passage permitting the venting of only a portion of the air forced into the air space by the priming bulb.

In one embodiment of the invention the priming bulb includes filter means for filtering air flowing from the priming bulb into the air space.

In a preferred embodiment of the invention the groove includes opposed intersecting sidewalls and the vent opening is located at the base of the groove and at the intersection of the sidewalls.

In a preferred form of the invention the vent opening has an elliptical shape and the major axis of the ellipse is colinear with the line defined by intersection of the sidewalls.

Various other features and advantages of the invention are set forth in the following description of a preferred embodiment, in the claims and in the drawings.

Figure 1:
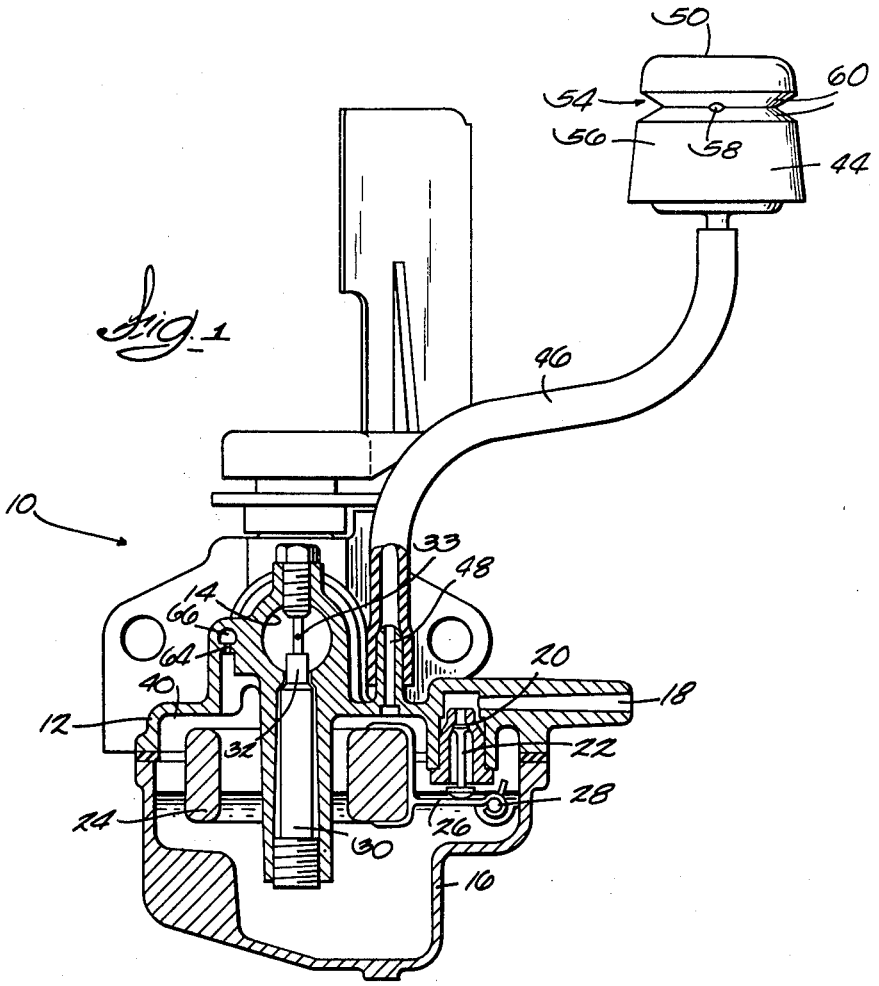
FIG. 1 is a cross section elevation view of a priming system for a carburetor employing the present invention.

Before explaining at least one of the embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a carburetor 10 for an internal combustion engine, which carburetor embodies the subject matter of the present invention. The carburetor 10 includes a body 12 having an air fuel passage 14 leading from an air intake (not shown) into the intake manifold of the engine or into the cylinders. The carburetor body 12 also includes a first bowl 16 adapted to contain liquid fuel, and a liquid fuel inlet 18 communicating with the float bowl 16 through a valve seat 20 having therein a passage adapted to be closed by a valve member 22.

The carburetor 10 also includes means for maintaining a proper leveel of fuel in the float bowl 16. In the illustrated construction, this means includes a float 24 supported by an arm 26 which is pivotably joined to the carburetor body 12 by a pivot pin 28. The valve member 22 is supported by the arm 26 and includes an upper end engageable with the valve seat 20 to restrict flow of liquid fuel into the float bowl 16 when the buoyancy of the float 24 in the liquid fuel causes the valve member 22 to move into engagement with the valve seat 20.

Means are also provided for conveying the liquid fuel from the float bowl 16 to the fuel-air mixture passage 14 of the carburetor. In the illustrated construction, this means comprises a fuel nozzle 30 extending upwardly from the float bowl 16 and having an upper end 32 projecting into the venturi section of the fuel-air mixture passage 14, the nozzle 30 including therein a liquid fuel passage having an orifice 33 for providing flow of liquid fuel from the float bowl into the fuel-air mixture passage 14.

Means are also provided for priming the engine for starting, i.e., for forcing fuel upwardly through the fuel nozzle 30 and into the fuel-air passage 14 at the time the engine is started. The priming means includes means for increasing the pressure of the air in the air space or chamber 40 in the fuel bowl and above the liquid fuel to thereby force the liquid fuel through the nozzle 30 into the air-fuel mixture passage 14. The means for forcing air into the air space 40 includes a bellows or primer bulb 44 connected by means of a hose or other flexible conduit 46 to an inlet opening 48 which communicates with the air space 40 in the float bowl.

The bellows or primer bulb 44 illustrated in the drawings comprises a generally cylindrical resilient structure having one end connected to the hose 46 and an opposite end defining a pressure surface 50 adapted to be pressed by the operator in order to compress the priming bulb 44, whereby air in the priming bulb 44 will be forced through the hose 46 and into the air chamber 40 of the float bowl 16. The priming bulb 44 also includes a groove 54 surrounding the periphery of the generally cylindrical surface portion 56 of the priming bulb 44, the groove 54 providing flexibility to the priming bulb and expansion and contraction of the air space in the priming bulb to thereby facilitate airflow through the hose 46 into the air chamber 40 of the float bowl 16. While the priming bulb 44 is illustrated in the drawings as having the shape of a truncated cone, it will be understood by those skilled in the art that the priming bulb 44 could have a variety of geometrical configurations such as spherical or cylindrical.

The priming bulb 44 also includes a vent opening 58 which is positioned so as to close as pressure is applied on the pressure surface or end wall 50 of the priming bulb. Such closure of the vent opening 58 is provided by positioning the vent opening 58 in the base of the groove 54 and by providing a vent opening which has a shape particularly adapted to cause the vent opening to close when the priming bulb is compressed. More particularly the groove 54 surrounding the priming bulb 44 includes converging generally planar sidewalls 60, and the vent opening is located at the base of the groove, i.e., at the convergence of these sidewalls 60. As illustrated in the drawings, the vent opening 58 has a football shape, with the longitudinal or major axis of the opening being coextensive with the line defined by the intersection of the converging side walls 60.

Figure 2:
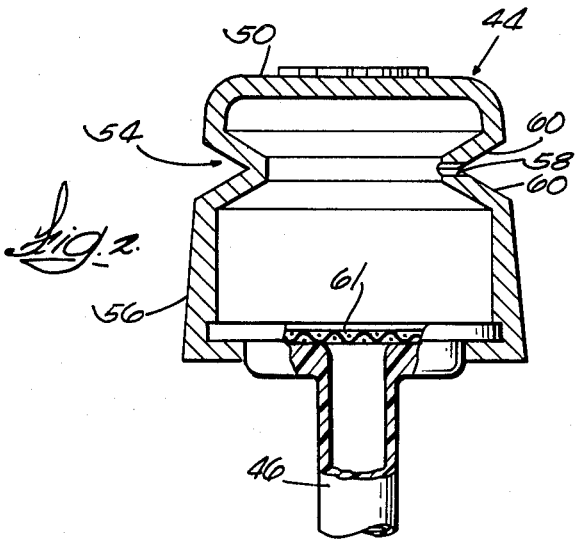
FIG. 2 is an enlarged cross section elevation view of the priming bulb illustrated in FIG. 1.
Figure 3:
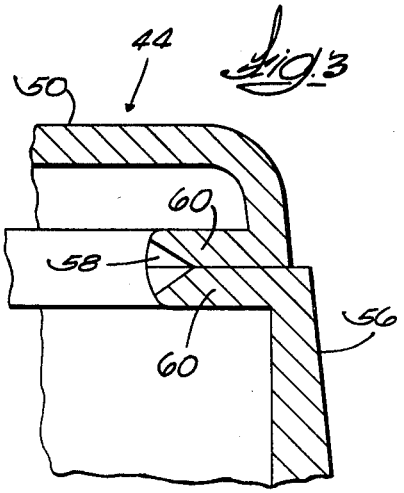
FIG. 3 is an enlarged view of a portion of the apparatus illustrated in FIG. 2 and showing the vent opening in the priming bulb closed.

In operation, and as illustrated in FIGS. 2 and 3, when the operator applies pressure on the pressure surface 50 of the priming bulb 44, the groove 58 surrounding the priming bulb permits the bulb to collapse and the sidewalls 60 of the priming bulb will tend to mate in face-to-face adjacent relation, thereby sealing off the vent opening and, as the priming bulb is further compressed, providing for airflow through the hose 46 and into the air chamber 40.

Means are also provided for filtering the air flowing through the conduit 46 into the air space 40. While the filtering means could have various constructions, in the illustrated arrangement it includes a filter 61 housed in the priming bulb 44 and positioned adjacent the inlet of conduit 46.

Means are further provided for limiting the increase of air pressure in the air chamber 40 as the priming bulb 44 forces air into the fuel bowl 16 and to thereby control the amount of liquid fuel passing through the nozzle 30 and into the fuel-air mixture passage 14. The means for controlling the increase in air pressure in the air chamber 40 includes a narrow orifice 64 providing a passage from the air chamber 40 of the float bowl to the atmosphere through a conduit 66. The cross sectional area of the orifice 64 is sufficiently small so that the rate of airflow from the air chamber 40 to the atmosphere is restricted. Accordingly, as air is forced into the air chamber 40, the pressure in the air chamber will increase. The orifice is of sufficient size, however, to provide for venting of air from the air chamber to the atmosphere and to limit the increase of air pressure in the air chamber 40 so as thereby to prevent the air pressure in the air chamber from becoming excessive.

The orifice 64 between the air chamber and the atmosphere also functions to provide a means for venting the air chamber during the normal operation of the engine once the engine has been started and thereby providing for uniform fuel flow through the nozzle. Similarly, the vent opening 58 in the priming bulb 44 also functions as a vent for the fuel bowl air chamber 40 during the normal operation of the engine and when the priming bulb is in its expanded state.

Various features of the invention are set forth in the following claims.

We claim:

1. An internal combustion engine including a carburetor for supplying the engine with a rich fuel-air mixture during priming and with a leaner mixture during normal operation, said carburetor including a body with a fuel-air mixture passage, a float bowl adapted to contain a quantity of liquid fuel and having an air space above the liquid fuel, said float bowl including an air inlet, a fuel nozzle for conducting fuel from the float bowl to the fuel-air mixture passage, a primer for aiding in starting the engine, the primer including means for selectively forcing air into said air space to cause the air pressure in said air space to be greater than atmospheric pressure and to cause liquid fuel to be forced through said nozzle and into said fuel-air mixture passage, said means for forcing including a flexible priming bulb adapted to be compressed to cause air to be forced into said air space and including a flexible wall portion including a groove and said priming bulb including a vent opening located in said groove so as to close as said priming bulb is compressed and as air is forced into the air space of the float bowl, and a conduit between the priming bulb and the air inlet.

2. An internal combustion engine as set forth in claim 1 and further including means for controlling the increase in air pressure in said air space as said priming bulb forces air into said air space and for venting to the atmosphere a portion of the air forced into said air space by said priming bulb, said means for venting including a narrow passage between said air space and the atmosphere.

3. An internal combustion engine as set forth in claim 1 wherein said priming bulb includes filter means for filtering air flowing from said priming bulb into said air space.

4. An internal combustion engine as set forth in claim 1 wherein said groove includes opposed intersecting sidewalls and wherein said vent opening is located at the intersection of said sidewalls.

5. An internal combustion engine as set forth in claim 4 wherein said vent opening has an elliptical shape including a major axis and wherein said major axis is colinear with the line defined by intersection of said sidewalls.

* * * * *